US006507180B2

(12) United States Patent
Eguchi

(10) Patent No.: US 6,507,180 B2
(45) Date of Patent: Jan. 14, 2003

(54) BANDGAP REFERENCE CIRCUIT WITH REDUCED OUTPUT ERROR

(75) Inventor: Yoshiki Eguchi, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/985,808

(22) Filed: Nov. 6, 2001

(65) Prior Publication Data

US 2002/0079876 A1 Jun. 27, 2002

(30) Foreign Application Priority Data

Nov. 7, 2000 (JP) ..... 2000-338703

(51) Int. Cl.[7] ..... G05F 3/16
(52) U.S. Cl. ..... 323/314; 323/316
(58) Field of Search ..... 323/313, 314, 323/315, 316

(56) References Cited

U.S. PATENT DOCUMENTS 4,346,344 A * 8/1982 Blauschild ..... 323/313
5,070,295 A * 12/1991 Morigami ..... 323/314
5,581,174 A * 12/1996 Fronen ..... 323/316
5,612,614 A * 3/1997 Barrett ..... 323/316
5,629,611 A * 5/1997 McIntyre ..... 323/313
5,751,142 A * 5/1998 Dosho et al. ..... 323/314
6,018,235 A * 1/2000 MiKuni ..... 323/316
6,031,365 A * 2/2000 Sharpe-Geisler ..... 323/313

FOREIGN PATENT DOCUMENTS

JP 6-175743 6/1994 ..... G05F/3/30
JP 10-232724 9/1998 ..... G05F/3/30
JP 11-161355 6/1999 ..... G05F/3/24
JP 2000-075945 3/2000 ..... G05F/3/02
JP 2000-181554 6/2000 ..... G05F/1/56

* cited by examiner

*Primary Examiner*—Jeffrey Sterrett
(74) *Attorney, Agent, or Firm*—Young & Thompson

(57) ABSTRACT

A bandgap reference (BGR) circuit of the present invention includes a first serial circuit made up of a first diode, a first transistor, and a first resistor. A second serial circuit includes a second diode having a greater current feed area than the first diode, a second transistor, and a second resistor. An amplifier amplifies a difference between the voltage drop of the first resistor and that of the second resistor. A third serial circuit includes a third transistor control led by the output of the amplifier, a third resistor and a fourth resistor, and a third diode. Opposite ends of the fourth resistor are respectively connected to the gate of the first transistor and the gate of the second transistor. A reference voltage appears on opposite ends of the portion of the third serial circuit including the third resistor, fourth resistor, and third diode.

10 Claims, 6 Drawing Sheets

*Fig. 3A*

| REFERENCE VOLTAGE $V_{REF}$ [V] | OUTPUT ERROR COMPONENT $\sigma_{VREF}$ [mV] | | ERROR RATIO $\sigma_{VREF}/V_{REF}$ [%] | |
|---|---|---|---|---|
| | $V_{OS}$, $\Delta$VTP | $V_{OS}$ ONLY | $V_{OS}$, $\Delta$VTP | $V_{OS}$ ONLY |
| 1.177 | ±14.5 | ±6.0 | ±1.23 | ±0.51 |

*Fig. 3B* PRIOR ART

| REFERENCE VOLTAGE $V_{REF}$ [V] | OUTPUT ERROR COMPONENT $\sigma_{VREF}$ [mV] | ERROR RATIO $\sigma_{VREF}/V_{REF}$ [%] |
|---|---|---|
| 1.273 | ±22.5 | ±1.77 |

BANDGAP REFERENCE CIRCUIT WITH REDUCED OUTPUT ERROR

BACKGROUND OF THE INVENTION

1. Field of the Invention

The present invention relates to a bandgap reference (BGR) circuit and more particularly to a BGR circuit for generating a reference voltage by using a MOS (Metal Oxide Semiconductor) transistor.

2. Description of the Background Art

Today, an analog circuit using a MOS transistor is replacing a conventional analog circuit using a bipolar transistor. Many of recent ICs (Integrated Circuits) have already been implemented by a CMOS process. A BGR circuit is a reference voltage generating circuit using a bandgap voltage and extensively used for measurement and control purposes. A BGR is capable of generating an extremely stable, low reference voltage.

However, conventional BGR circuits has some problems that will be described specifically later. Particularly, the conventional BGR circuit cannot reduce an error with respect to a designed reference voltage or a temperature drift.

Technologies relating to the present invention are disclosed in, e.g., Japanese Patent Laid-Open Publication Nos. 6-175743, 10-232724, 11-161355, 2000-75945 and 2000-181554.

SUMMARY OF THE INVENTION

It is an object of the present invention to provide a BGR circuit capable of reducing an error with respect to a designed reference voltage and a temperature drift.

A BGR circuit of the present invention includes a first serial circuit made up of a first diode, a first transistor, and a first resistor. A second serial circuit includes a second diode having a greater current feed area than the first diode, a second transistor, and a second resistor. An amplifier amplifies a difference between the voltage drop of the first resistor and that of the second resistor. A third serial circuit includes a third transistor control led by the output of the amplifier, a third resistor and a fourth resistor, and a third diode. Opposite ends of the fourth resistor are respectively connected to the gate of the first transistor and the gate of the second transistor. A reference voltage appears on opposite ends of the portion of the third serial circuit including the third resistor, fourth resistor, and third diode.

BRIEF DESCRIPTION OF THE DRAWINGS

The above and other objects, features and advantages of the present invention will become more apparent from the following detailed description taken with the accompanying drawings in which:

FIGS. 3A and 3B are tables listing the results of simulations effected with the conventional GBR circuit and the BGR circuit of FIG. 2, respectively.

DESCRIPTION OF THE PREFERRED EMBODIMENTS

Figure 1:
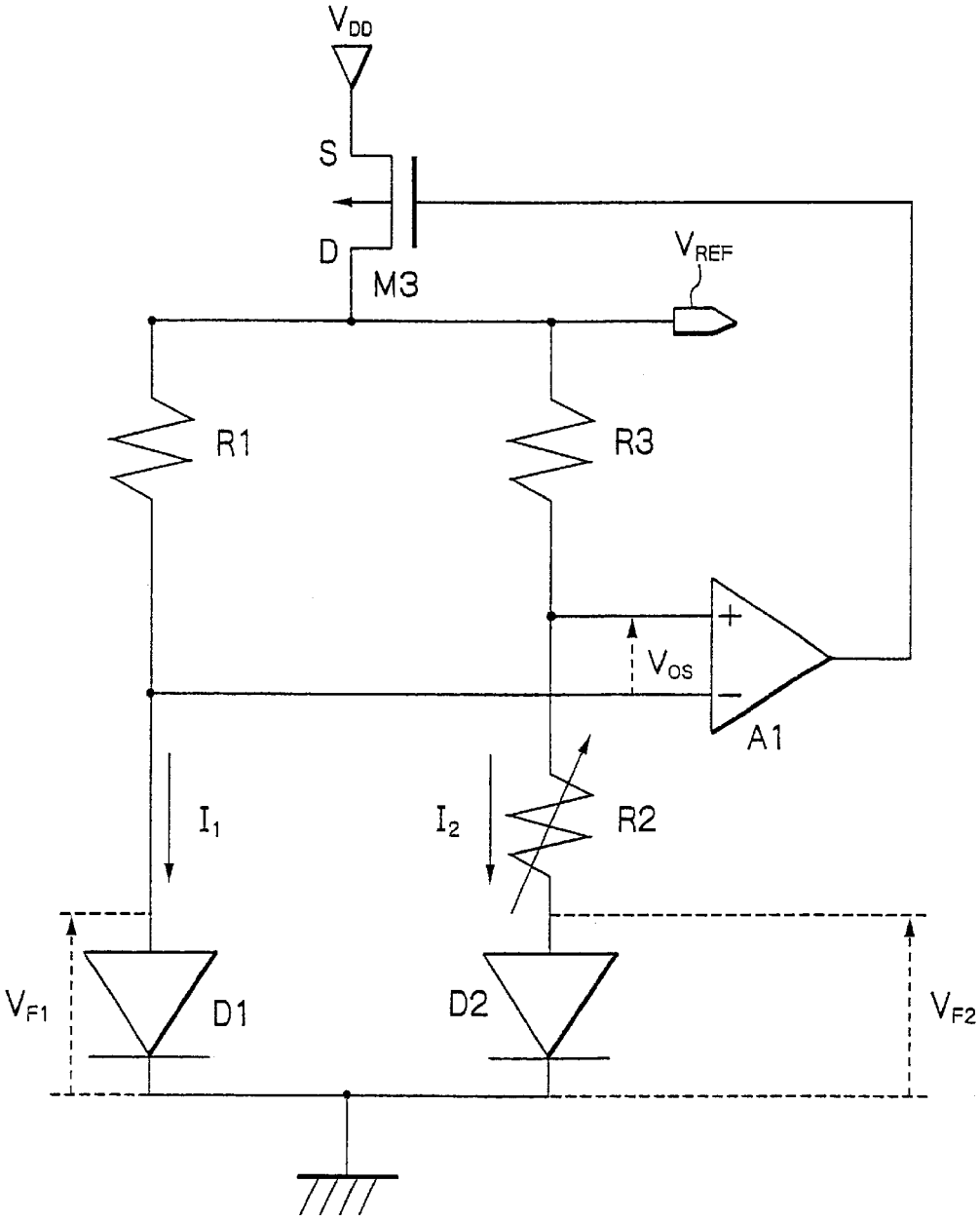
(PRIOR ART) Fig. 1
FIG. 1 is a circuit diagram showing a conventional GBR circuit.

To better understand the present invention, brief reference will be made to a conventional BGR circuit, shown in FIG. 1. As shown, the conventional BGR circuit includes diodes D1 and D2, resistors R1, R2 and R3, an operational amplifier (OP AMP hereinafter) A1, and a transistor M3. A temperature-compensated reference voltage $V_{REF}$ appears on the drain of the transistor M3 on the basis on the sum of the forward voltage drop of the diode D1 and the voltage drop of the resistor R1, i.e., a bandgap voltage.

The conventional BGR circuit operates with the following principle. Assume that the ratio of the diode D2 to the diode as to a current feed area is n, that the forward voltage drops of the diodes D1 and D2 are VF1 and VF2, respectively, that the reverse saturation current of the diode D1 is Is, a Boltzmann constant is κ, that the absolute temperature is T, and that an elementary charge is q. Then, currents I1 and I2 to flow through the diodes D1 and D2, respectively, are expressed as:

$$I1 = I_S \cdot \left(e^{\frac{q \cdot V_{F1}}{\kappa \cdot T}} - 1\right) \approx I_S \cdot e^{\frac{q \cdot V_{F1}}{\kappa \cdot T}} \quad \text{Eq. (1)}$$

$$I2 = n \cdot Is \cdot \left(e^{\frac{qVF2}{kT}} - 1\right) \approx n \cdot Is \cdot e^{\frac{qVF2}{kT}} \quad \text{Eq. (2)}$$

The voltage drops VF1 and VF2 are derived from the above Eqs. (1) and (2):

$$VF1 \approx (\kappa \cdot T/q) \cdot 1n[I1/Is] \quad \text{Eq. (3)}$$

$$VF2 \approx (\kappa \cdot T/q) \cdot 1n[I2/(N \cdot Is)] \quad \text{Eq. (4)}$$

A difference ΔVF between the voltage drops VF1 and VF2 is produced from the Eqs. (3) and (4):

$$\Delta VF = VF1 - VF2 = (\kappa \cdot T/q) \cdot 1n[(n \cdot I1)/I2] - (\kappa \cdot T/q) \cdot 1n[(n \cdot R3)/R1] \quad \text{Eq. (5)}$$

Assuming that an offset voltage is VOS, then the following equation holds with a closed circuit made up of the OP AMP A1, diodes D1 and D2 and resistor R2:

$$VOS = (VF2 + I2 \cdot R2) - VF1 \quad \text{Eq. (6)}$$

From the Eq. (6), the current I2 is expressed as:

$$I2 = \{(VF1 - VF2) + VOS\}/R2 = (\Delta VF + VOS)/R2 \quad \text{Eq. (7)}$$

Assume that the offset voltage VOS is sufficiently smaller than the voltage drop of the resistors R1 and R3. Then, the reference voltage VREF appearing on opposite ends of the resistor R1 and diode D1 is produced from I1·R1=I2·R3+VOS≈I2·R3:

$$VREF = VF1 + I1 \cdot R1 \approx VF1 + I2 \cdot R3 = VF1 + R3 \cdot I2 = VF1 + (R3/R2) \cdot (\Delta VF + VOS) = VF1 + (R3/R2) \cdot \Delta VF + (R3/R2) \cdot VOS \quad \text{Eq. (8)}$$

An output error component σVREF representative of the influence of the offset voltage VOS is derived from the third term of the Eq. (8):

$$\sigma VREF=(R3/R2)\cdot VOS \quad \text{Eq. (9)}$$

The equation (9), in turn, derives a condition for reducing the error, i.e., the influence of the offset voltage VOS:

$$(R3/R2)<<1 \quad \text{Eq. (10)}$$

The Eq. (10) shows that the influence of the offset voltage VOS on the reference voltage VREF and therefore the error of the reference voltage VREF with respect to a designed value is reduced.

Next, the Eq. (5) is substituted for the Eq. (8) and then subjected to partial differentiation using the absolute temperature T, thereby producing the temperature coefficient K of the reference voltage VREF:

$$\begin{aligned} K &= \frac{\partial V_{REF}}{\partial T} \\ &= \frac{\partial V_{F1}}{\partial T} + \frac{R3}{R2}\cdot\frac{\partial}{\partial T}\left\{\frac{\kappa\cdot T}{q}\cdot\ln\left[\frac{R3}{R1}n\right]\right\} + \frac{R3}{R2}\cdot\frac{\partial V_{OS}}{\partial T} \\ &\approx \frac{\partial V_{F1}}{\partial T} + \frac{R3}{R2}\cdot\frac{\kappa}{q}\cdot\ln\left[\frac{R3}{R1}n\right] \end{aligned} \quad \text{Eq. (11)}$$

In the above Eq. (11), the temperature drift of the offset voltage VOS is assumed to be sufficiently smaller than the other temperature drifts. The Eq. (11) derives a temperature compensation condition for reducing the temperature coefficient K to zero:

$$\frac{\partial V_{F1}}{\partial T} = -\frac{R3}{R2}\cdot\frac{\kappa}{q}\cdot\ln\left[\frac{R3}{R1}n\right] \quad \text{Eq. (12)}$$

The Eq. (12) shows that the temperature drift of the reference voltage VREF is compensated for.

As stated above, the conventional BGR circuit reduces the influence of the offset voltage VOS by satisfying the Eq. (10) and compensates for the temperature drift by satisfying the Eq. (12). The BGR circuit, however, has the following problems left unsolved.

To satisfy the Eq. (12) on the basis of the Eq. (10), it is necessary to increase (R3/R1)·n. This cannot be done unless the current feed area of the diode D2 is increased relative to that of the diode D1 and unless the current I1 is increased relative to the current I2. As a result, the current density of the diode D2 becomes extremely lower than the current density of the diode D1. This makes it almost impossible to allow an ordinary analog circuit to stably operate with target characteristics due to, e.g., irregularity particular to an IC production process.

Moreover, the extremely low current density of the diode D2 results in an increase in the current feed areas of the diodes D1 and D2 and therefore an increase in the area of the entire IC chip. The current feed area ratio n and resistance ratio (R3/R1) should preferably be between 4 and 20 and about 1, respectively, from the design standpoint. It is therefore impracticable to satisfy both of the error reduction condition and temperature compensation condition.

Figure 2:
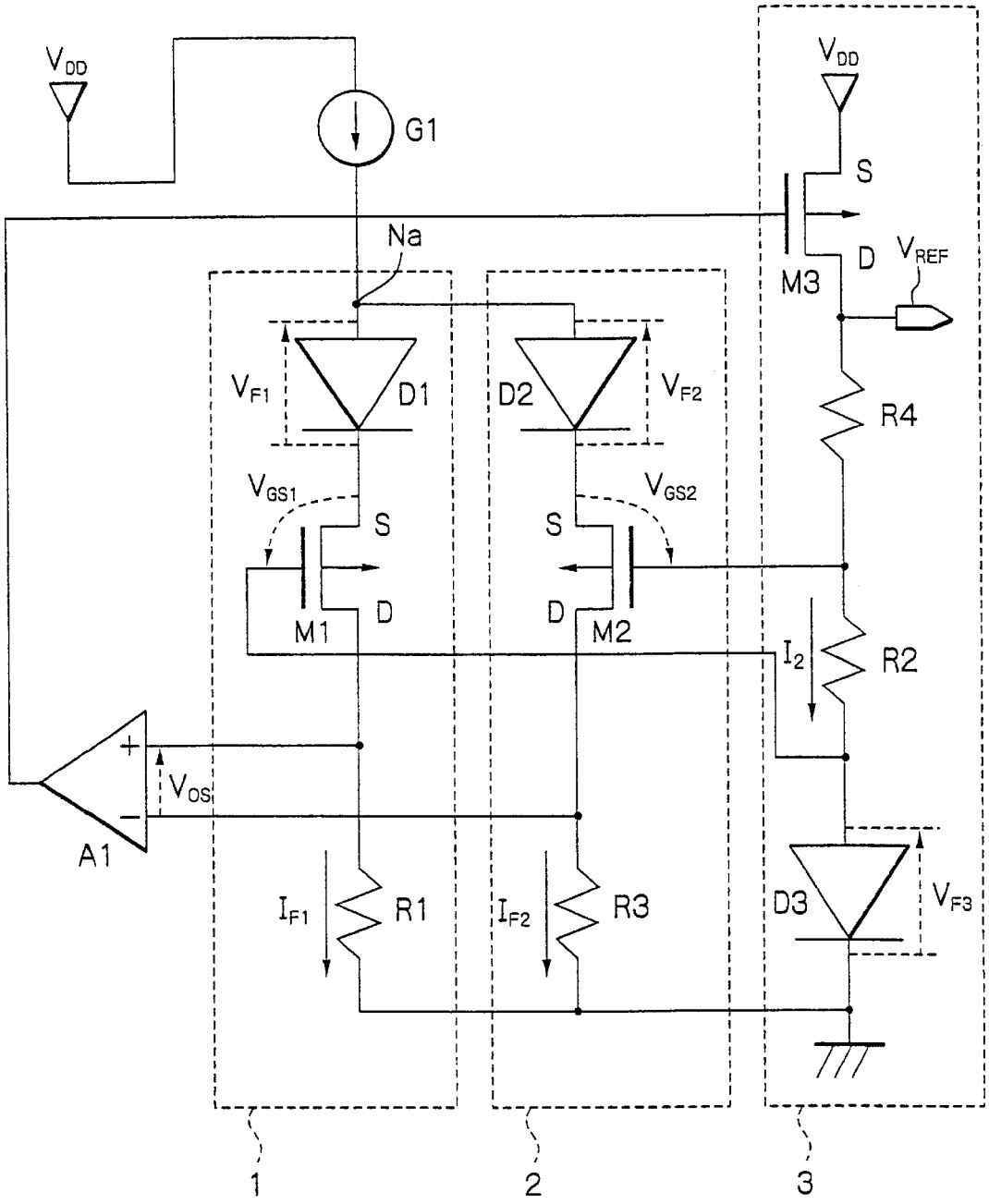
FIG. 2 is a circuit diagram showing a BGR circuit embodying the present invention.

Referring to FIG. 2 a BGR circuit embodying the present invention will be described. As shown, the BGR circuit includes an OP AMP A1, a constant current source G1, diodes D1, D2 and D3, p-channel MOS transistors M1, M2 and M3, and resistors R1, R2, R3 and R4. The diode D1, transistor M1 and resistor R1 constitute a first serial circuit 1. Likewise, the diode D2, transistor M2 and resistor R3 constitute a second serial circuit 2. Further, the transistor M3, resistors R2 and R4 and diode D3 constitute a third serial circuit 3.

The diode D2 has a current feed area n times as great as the current feed area of the diode D1. The constant current source G1 and OP AMP A1 each have a conventional configuration. The internal equivalent circuit and designing method are not shown or will not be described specifically.

The constant current source G1 is connected to a power source voltage VDD (high-tension power source) at one terminal thereof. The other terminal of the constant current source G1, the anode terminal of the diode D1 and the anode terminal of the diode D2 are connected to a node Na. The cathodes of the diodes D1 and D2 are connected to the sources of the transistors M1 and M2, respectively.

The gate of the transistor M1 is connected to one end of the resistor R2 and the anode of the diode D3. The drain of the transistor M1 is connected to the non-inverting input of the OP AMP A1 and one end of the resistor R1. The gate of the transistor M2 is connected to one end of the resistor R4 and the other end of the resistor R2. The drain of the transistor M2 is connected to the inverting input of the OP AMP A1 and one end of the resistor R3.

The output of the OP AMP A1 is connected to the gate of the transistor M3. The source and drain of the transistor M3 are connected to the power source voltage VDD and the other end of the resistor R4, which is the output of the BGR circuit. The other end of the resistor R1, the other end of the resistor R3 and the cathode of the diode D3 are connected to ground (low-tension voltage power source).

The illustrative embodiment additionally includes a temperature compensation circuit having a positive temperature coefficient. The positive temperature coefficient is equal in absolute value to the negative temperature coefficient of the forward voltage of a diode. The positive and negative temperature coefficients cancel each other and allow the BGR circuit to generate a temperature-compensated, extremely stable reference voltage. It is to be noted that a bandgap refers to a bandwidth Eg between a valence band and a conduction band, which are quantum-mechanical terms. In the case of silicon (Si), the bandwidth Eg is 1.11 eV quite close to a reference voltage VREF nearly equal to 1.2 V. This is why the circuit is called a BGR circuit.

As for an OP AMP, even if a differential input pair made up of a non-inverting input and an inverting input is reduced to zero, the output voltage does not become zero due to, e.g., irregularity particular to production. However, the output voltage becomes zero when an offset voltage VOS is applied to the differential input pair. A BGR circuit using an OP AMP involves an error with respect to a designed reference voltage VREF due to the influence of the offset voltage VOS.

The constant current source G1 splits a preselected constant current into two. One of the two currents is input to the second serial circuit 2 while the other current is input to the second serial circuit 2. The entire current input to the first serial circuit flows to ground via the diode D1, transistor M1 and resistor R1 as a current IF1. Likewise, the entire current input to the second serial circuit flows to ground via the diode D2, transistor M2 and resistor R3 as a current IF2.

The transistor M3 feeds a preselected current to the third serial circuit 3 on the basis of the output voltage of the OP AMP A1. The entire current input to the third serial circuit 3 flows to ground via the resistors R4 and R2 and diode D3 as a current I2.

The transistor M1 has a threshold voltage of VTP1 and a voltage of VGS1 between the gate and the source. The transistor M2 has a threshold voltage of VTP2 and a voltage of VGS2 between the gate and the source. The forward voltage drops of the diodes D1, D2 and D3 are VF1, VF2 and VF3, respectively. The offset voltage VOS appears between the inverting terminal and the non-inverting terminal of the OP AMP A1.

The OP AMP A1 controls the current I2 output from the transistor M3 in accordance with a difference between the forward voltage drops of the diodes D1 and D2. The transistors M1 and M2 respectively control the currents IF1 and IF2 in accordance with the size of the current I2. The resistors R2 and R4 through which the current I2 flows plays the role of the temperature compensation circuit having the positive temperature coefficient. The third serial circuit 3 cancels the negative temperature coefficient of the diode D3 and the positive temperature coefficient of the resistors R2 and R4 through which the current I2 flows. The current I2 is a positive temperature drift. The BGR circuit generates a reference voltage that is the sum of the voltage drops of the resistors R2 and R4 and the forward voltage drop VF3 of the diode D3.

The principle of operation of the illustrative embodiment will be described hereinafter. Assume that a threshold voltage difference (VTP1−VTP2) between the transistors M1 and M2 is ΔVPT, that a difference in voltage between the gate and the source between the transistors M1 and M2 is ΔVGS, and that a difference in forward voltage drop between the diodes D1 and D2 (VF1−VF2) is ΔVF. Then, the following relation holds with the closed circuit made up of the OP AMP A1 and resistors R1 and R3:

$$IF1 \cdot R1 = IF2 \cdot R3 + VOS \quad \text{Eq. (13)}$$

Assuming a first design condition of R3=R1 for easy circuit design, then IF2 is produced from the Eq. (13):

$$IF2 = (R1/R3) \cdot IF1 - (VOS/R3) = IF1 - (VOS/R1) \quad \text{Eq. (14)}$$

Assume that the transistors M1 and M2 have gate lengths of L1 and L2 and gate widths of W1 and W2, respectively, that the mobility of holes is $\mu$p in both of the transistors M1 and M2, and that the gate capacity for a unit time is COX in both of the transistors M1 and M2. Then, drain currents IF1 and IF2 that flow through the transistors M1 and M2, respectively, are expressed as:

$$IF1 = \mu p \cdot COX/2 \cdot (W1/L1) \cdot (VGS1 - VTP1)^2 \quad \text{Eq. (15)}$$

$$IF2 = \mu p \cdot COX/2 \cdot (W2/L2) \cdot (VGS2 - VTP2)^2 \quad \text{Eq. (16)}$$

When the Eq. (16) is substituted for the Eqs. (14) and (15), there holds:

$$\mu p \cdot COX/2 \cdot (W2/L2) \cdot (VGS2 - VTP2)^2 = \mu p \cdot COX/2 \cdot (W1/I1) \cdot (VSG1 - VTP1)^2 - (VOS/R1) \quad \text{Eq. (17)}$$

Any suitable function D1[x] is defined in order to transform the right side of the Eq. (17); D1[x] is smaller than zero if x is smaller than zero or greater than or equal to zero if x is greater than or equal to zero. Then, the following equation holds:

$$\mu p \cdot COX/2 \cdot (W2/L2) \cdot (VGS2 - VTP2)^2 = \mu p \cdot COX/2 \cdot (W1/L1) \cdot (VGS1 - VTP1 + D1[VOS/R1])^2 \quad \text{Eq. (18)}$$

Assuming second design conditions of L1=L2 and W1=W2, then the Eq. (18) is simplified as follows:

$$VGS2 - VTP2 = VGS1 - VTP1 + D1[VOS/R1] \quad \text{Eq. (19)}$$

A difference ΔVGS between the transistors M1 and M2 as to the voltage between the gate and the source is produced from the Eq. (19):

$$\Delta VGS = VGS1 - VGS2 = VTP1 - VTP2 - D1[VOS/R1] = \Delta VTP - D1[VOS/R1] \quad \text{Eq. (20)}$$

A potential Va at the node Na is produced from both of the path including the diode D1, transistor M1 and diode D3 and the path including the diode D2, transistor M2, resistor R2 and diode D3, as follows:

$$Va = VF1 + (-VGS1) + VF3 = VF2 + (-VGS2) + I2 \cdot R2 + VF3 \quad \text{Eq. (21)}$$

I2 is produced from the Eq. (12):

$$I2 = \{(VF1 - VF2) - (VGS1 - VGS2)\}/R2 = (\Delta VF - \Delta VGS)/R2 \quad \text{Eq. (22)}$$

A reference voltage VREF to appear on both ends of the serial circuit made up of the resistors R4 and R2 and diode D3 is expressed as:

$$VREF = I2 \cdot (R4 + R2) + VF3 \quad \text{Eq. (23)}$$

By substituting the Eq. (22) for the Eq. (23), there is produced:

$$VREF = VF3 + \{(\Delta VF - \Delta VGS)/R2\} \cdot (R4 + R2) = VF3 + \{(R4 + R2)/R2\} \cdot \Delta VF - \{(R4 + R2)/R2\} \cdot \Delta VGS \quad \text{Eq. (24)}$$

In the Eq. (24), the third term of the right side is an output error component σVREF. As Eq. (21) indicates, ΔVGS contains the threshold voltage difference ΔVTP between the transistors M1 and M2 and the offset voltage VOS of the OP AMP A1. The threshold voltage difference ΔVTP and offset voltage VOS differ from one sample to another sample due to various causes particular to an IC production process. The output error component σVREF is the major factor that introduces an error in the designed value of the reference voltage VREF, and is derived from the Eq. (20):

$$\sigma VREF = \{(R2 + r4)/r2\} \cdot \Delta VGS = \{(R2 + R4)/R2 \cdot\} \cdot \{\Delta VTP - D1[VOS/R1]\} \quad \text{Eq. (25)}$$

Assume that the temperature coefficient of the reference voltage VREF is K1, and that the temperature coefficient of the forward voltage drop VF3 of the diode D3 is K2. Then, by substituting the Eq. (5) for the Eq. (24), the equation is simplified under the first design condition. Partial differentiation using the temperature T derives:

$$K_1 = \frac{\partial V_{REF}}{\partial T} \quad \text{Eq. (26)}$$

-continued $$= \frac{\partial V_{F3}}{\partial T} + \frac{R2+R4}{R2} \cdot \frac{\partial}{\partial T}\left\{\frac{\kappa \cdot T}{q} \cdot \ln[n]\right\} + \frac{R2+R4}{R2} \cdot \frac{\partial}{\partial T}\left(\Delta V_{TP} - D1\left[\frac{V_{OS}}{R1}\right]\right)$$

$$= K_2 + \frac{R2+R4}{R2} \cdot \frac{\kappa}{q} \cdot \ln[n] + \frac{R2+R4}{R2} \cdot \frac{\partial}{\partial T}\left(\Delta V_{TP} - D1\left[\frac{V_{OS}}{R1}\right]\right)$$

The temperature coefficients of the resistors R2 and R2 cancel each other when the same device structure is uses. As the Eq. (20) indicates, ΔVGS in the third term of the Eq. (26) contains the threshold voltage difference ΔVTP between the transistors M1 and M2 and the offset voltage VOS of the OP AMP A1. The temperature coefficient of the threshold voltage difference ΔVTP and that of the offset voltage VOS are sufficiently smaller than the temperature coefficients K1 and K2. Therefore, by neglecting the third term of the Eq. (26), there holds:

$$K1=K2+(R2+R4)/R2\cdot(\kappa/q)\cdot In[n] \quad \text{Eq. (27)}$$

The Eq. (27) derives a temperature compensation condition that reduces the temperature coefficient K1 of the reference voltage VREF to zero, as follows:

$$K2=-(R2+R4)/R2\cdot(\kappa/q)\cdot In[n] \quad \text{Eq. (28)}$$

The temperature coefficient K2 of the forward voltage drop of the diode D3 is known beforehand. The temperature compensation condition of Eq. (28) is satisfied when the resistors R2 and R4 are provided with preselected values. More specifically, the values of the resistors R2 and R4 are determined when the temperature compensation condition is satisfied. The Eq. (25) is used to determine a condition that reduces the error of the output error component a σREF. ΔVTP randomly occurs due to irregularity particular to the IC production process. The any suitable function D1[VOS/R1] representative of the influence of the offset voltage VOS randomly occurs, too. These two factors therefore are independent of each other and cannot cancel each other. It follows that the Eq. (25) may be generalized, as follows:

$$\sigma VREF=\{(R2+R4)/R2\}\cdot\{|\Delta VTP|+|D1[VOS/R1]|\} \quad \text{Eq. (29)}$$

ΔVTP is noticeably dependent on relative accuracy between the transistors M1 and M2. Therefore, to reduce ΔVPT as far as possible, it is necessary to sufficiently increase the size of the transistors M1 and M2 and devise the layout thereof.

It is difficult to express the function D1[VOS/R1] in a sophisticated, specific way. Nevertheless, because this function has VOS/R1 as a variable, the variable becomes small if R1 (as well as R3 that is the first design condition) is made as great as possible in order to reduce D1[VOS/R1] itself.

Theoretically estimating errors based on the Eq. (29) is time-consuming and difficult. To prove the advantages of the illustrative embodiment, simulations were conducted with a device model close to an actual solution by using SPICE or similar analog circuit simulator. An actual device model was reproduced with the input offset voltage VOS and threshold voltage difference ΔVTP each being set at a particular initial value.

The input offset voltage VOS is presumable ascribable to the fact that a pair of MOS transistors, which constitute the differential amplifier stage of an OP AMP, are produced with their full symmetry lost by an IC production process. The offset voltage VOS varies within the range of ±2 to 3 mV sample by sample.

The threshold voltage influences the characteristics of a MOS transistor most noticeably as to relative accuracy between paired MOS transistors. In light of this, fine adjustment was made to provide each of the paired MOS transistors with a particular threshold voltage for thereby setting up a relative error, i.e., disturbing symmetry. In this configuration, a first initial condition that implemented the input offset voltage VOS lying in the range of ±2 to 3 mV was set.

The threshold voltage difference VPT pertains to the transistors M1 and M2. Fine adjustment was also made to provide each of the transistors M1 and M2 with a particular threshold voltage in the same manner as with the input threshold voltage VOS, thereby setting a second initial condition.

FIGS. 3A and 3B compare the conventional BGR circuit of FIG. 1 and the BGR circuit of the illustrative embodiment of FIG. 2 as to the output error component σVREF and an error rate, i.e., a ratio of the error component σVREF to the reference voltage VREF.

FIG. 3A shows the results of simulation effected with the illustrative embodiment. As shown, in the illustrative embodiment, the designed reference value VREF is 1.77 V. The first and second initial conditions are applied to the input offset voltage VOS and threshold voltage difference ΔVPT, respectively. When the first and second initial conditions both were set, the output error component was ±14.5 mV while the error rate was ±1.23%. When the first initial condition was set alone, the output error component and error rate were ±6.0 mV and ±0.51%, respectively.

FIG. 3B shows the results of simulation effected with the conventional RGB circuit. As shown, the designed reference value VREF was 1.273 V, and the first initial condition was applied to the input offset voltage VOS. The output error component and error ratio were ±22.5 mV and ±1.77%, respectively.

It will be seen that the illustrative embodiment reduces both of the output error component and error ratio more than the conventional BGR circuit. The illustrative embodiment therefore reduces the error of the reference voltage VREF with respect to the designed value and thereby enhances the accuracy of the reference voltage circuit.

As Eqs. (25) and (29) indicate, the transistors M1 and M2 bring about the threshold voltage difference ΔVTP as another cause of the error of the reference voltage VREF in addition to the input offset voltage VOS. The illustrative embodiment successfully reduces the influence of the input offset voltage VOS and therefore reduces the error of the reference voltage VREF despite the above difference ΔVTP because the voltage VOS has more critical influence than the difference ΔVTP. By contrast, the conventional BGR circuit cannot reduce the influence of the input offset voltage VOS at all.

In the illustrative embodiment, an amplifier controls a current to flow through a third serial circuit on the basis of a difference between the voltage drops of a first and a second resistor. Also, a first and a second transistor control a difference between the forward voltage drops of a first and a second diode on the basis of the current flowing through the serial circuit. For the former control and the latter control, use is made of feedback control circuitry.

The third serial circuit generates a voltage drop in accordance with a current flowing through a third and a fourth resistor and a third diode and outputs the voltage drop as a reference voltage. This successfully reduces the influence of an offset voltage particular to the amplifier to thereby reduce an error with respect to a designed value.

The voltage drops of the third and fourth resistors have a positive temperature coefficient each while the forward voltage drop of the third diode has a negative temperature coefficient. The former temperature coefficient and the latter temperature coefficient are equal in size and therefore cancel each other, thereby reducing a temperature drift.

Figure 4:
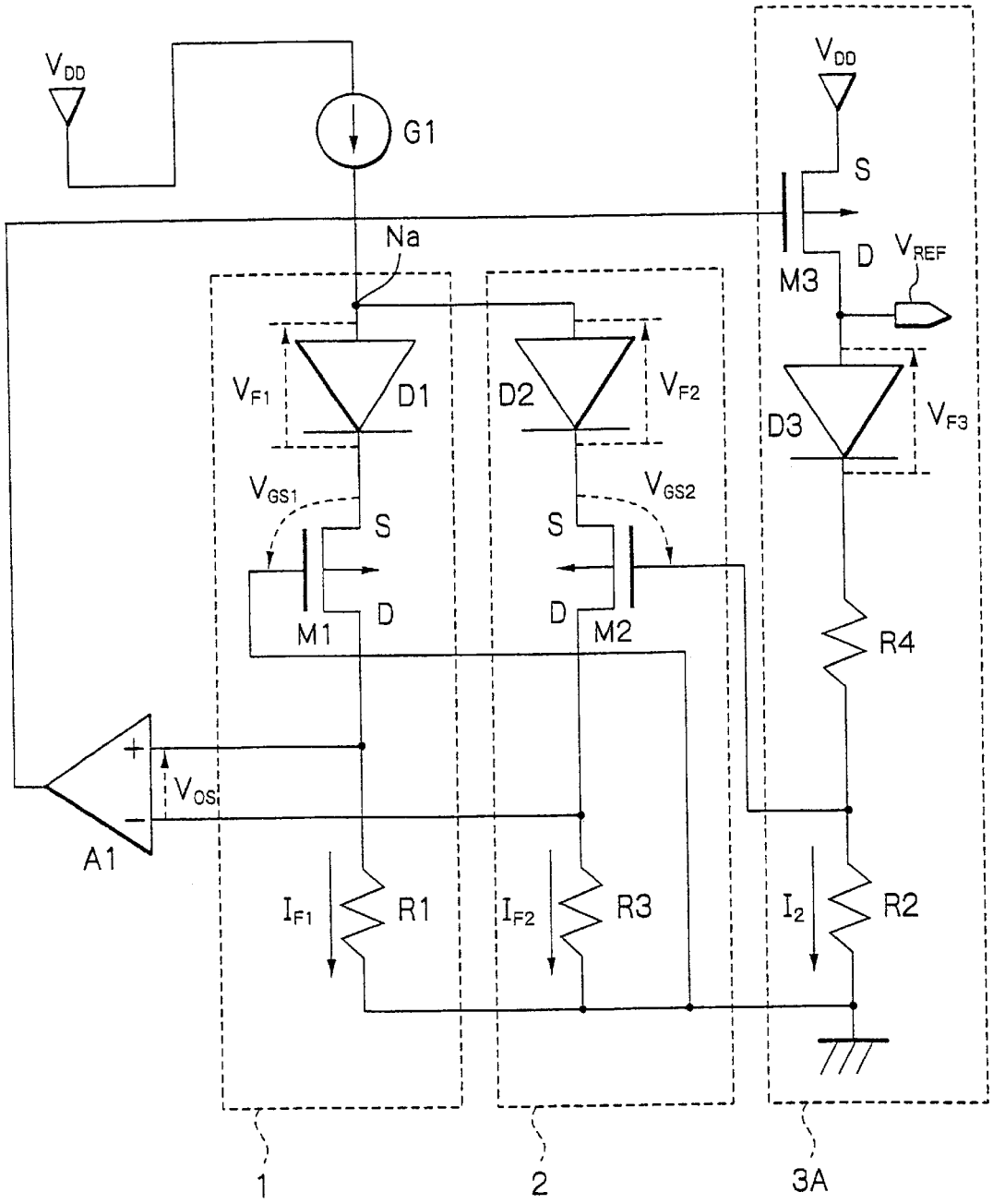
FIG. 4 is a circuit diagram showing an alternative embodiment of the present invention.

FIG. 4 shows an alternative embodiment of the BGR circuit in accordance with the present invention. As shown, this embodiment differs from the previous embodiment in that the third serial circuit 3 is replaced with a third serial circuit 3A. In the third serial circuit 3A, the drain of the transistor M3 is connected to the anode of the diode D3. The cathode of the diode D3 is connected to one end of the resistor R2 and the gate of the transistor M2 via the resistor R4. The gate of the transistor M1 and the other end of the resistor R2 are connected to ground. The reference voltage VREF appears on the anode of the diode D3.

As for the p-channel transistors M1 and M2, the bias point of the gate voltage is shifted to the ground side by the forward voltage drop VF3 of the diode D3. The illustrative embodiment is therefore operable even when the power source voltage is lowered by the forward voltage drop VF3. Considering the voltage between the drain and the source, the voltage between the gate and the source and the threshold voltage of each of the transistors M1 and M2, the BGR circuit is designed such that the transistors M1 and M2 operate in the saturation range. This embodiment is identical with the previous embodiment as to temperature compensation and error reduction.

As stated above, the illustrative embodiment broadens the operable, power source voltage range by the forward voltage drop VF3.

Figure 5:
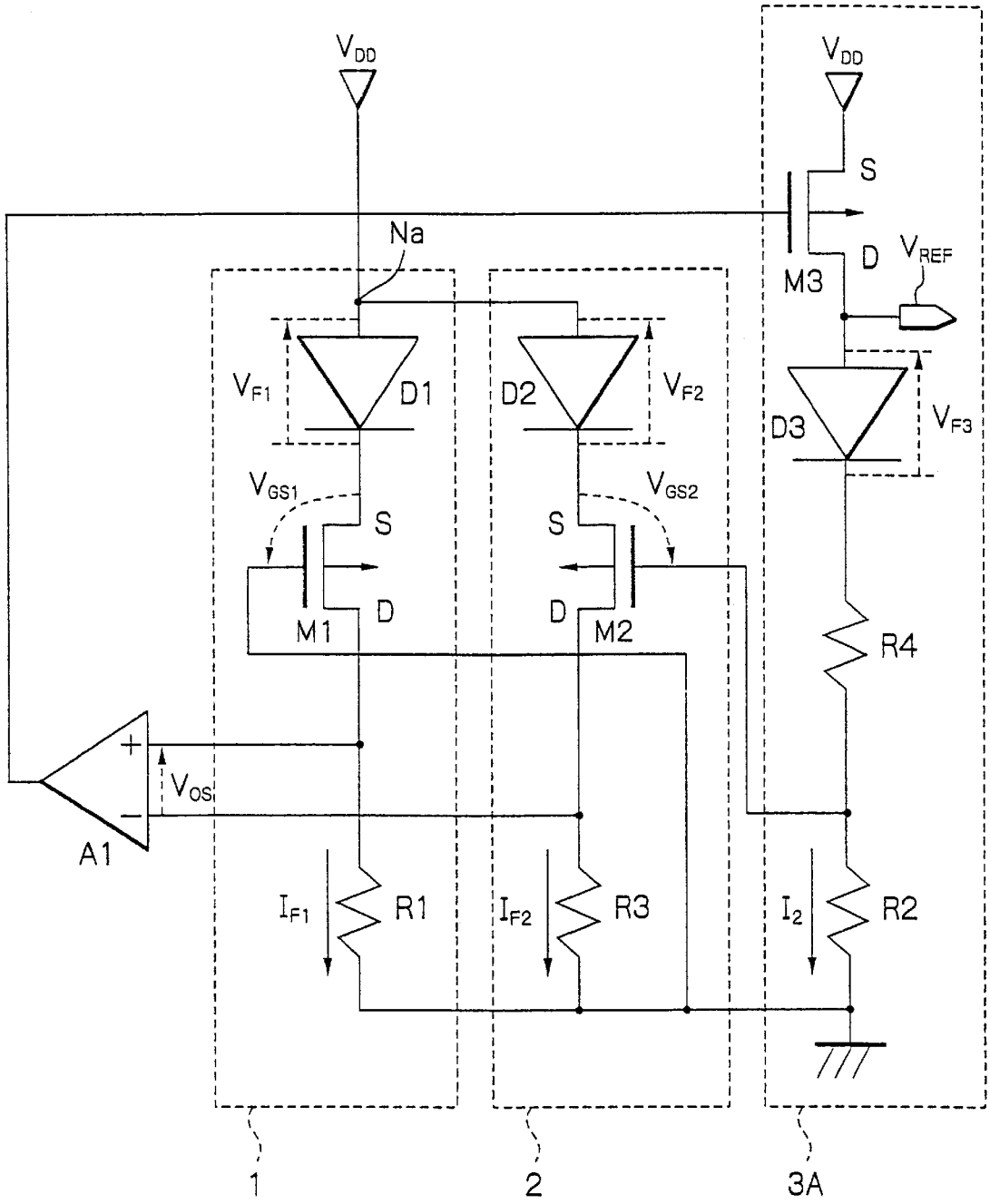
FIG. 5 is a circuit diagram showing another alternative embodiment of the present invention.

FIG. 5 shows another alternative embodiment of the present invention. As shown, this embodiment differs from the previous two embodiments in that the constant current source G1 is absent. The constant current source G1 feeds a constant current to the first and second serial circuits 1 and 2 at all times, allowing the BGR circuit to stably operate despite power source voltage variation and reduce power consumption when the power source voltage is high. It will therefore be seen that the constant current source 1 is omissible if the RGB circuit has a low power source voltage VDD. As for temperature compensation and error reduction, this embodiment is identical with the previous embodiments.

Figure 6:
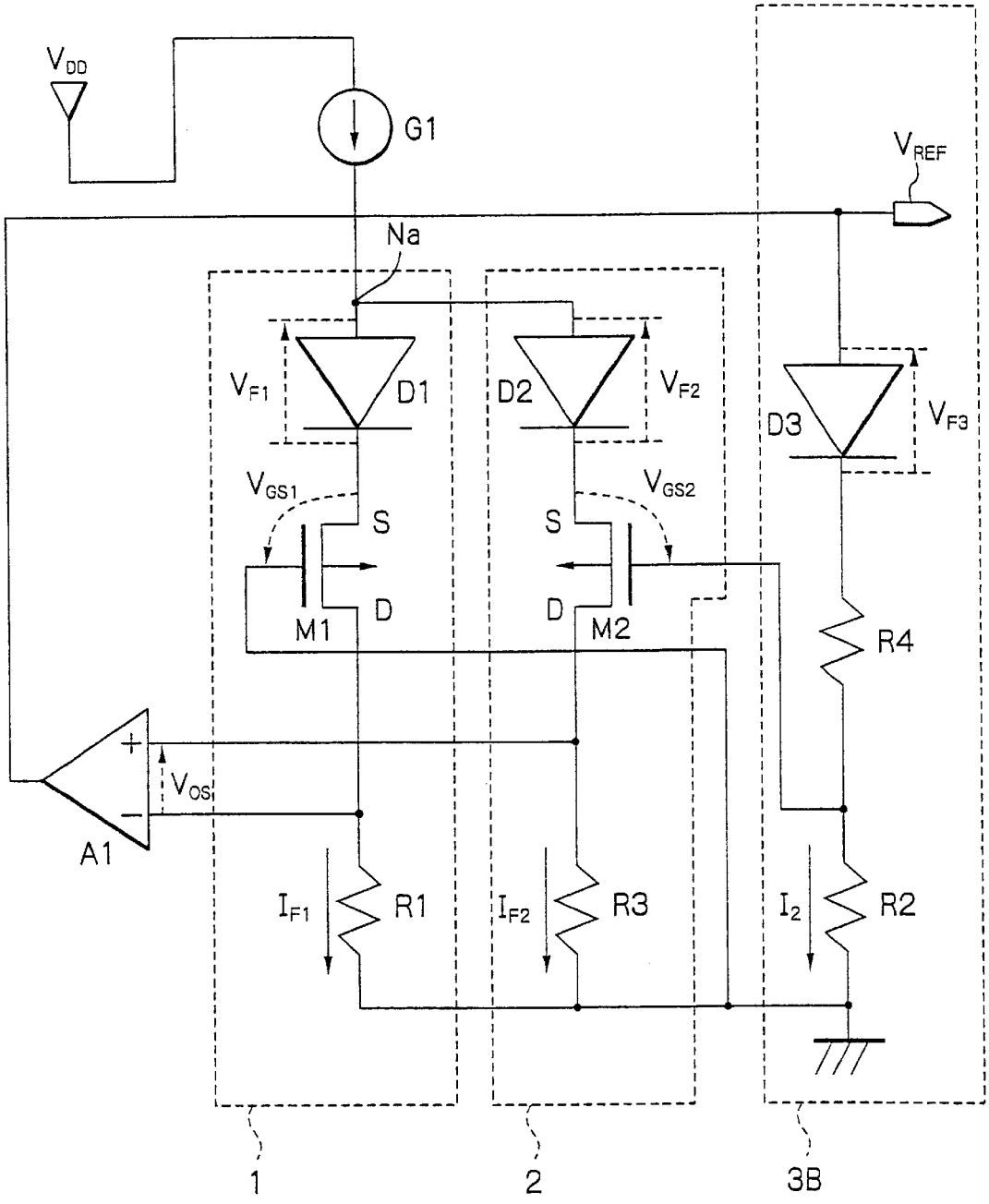
FIG. 6 is a circuit diagram showing a further alternative embodiment of the present invention.

FIG. 6 shows a further alternative embodiment of the present invention. As shown, this embodiment differs from the embodiment of FIG. 4 in that the connection of the OP AMP A1 is modified and in that the third serial circuit 3A is replaced with a third serial circuit 3B in which the transistor M3 is absent. Specifically, the output of the OP AMP A1 is connected to the anode of the diode D3. The non-inverting input of the OP AMP A1 is connected to the drain of the transistor M2 and one end of the resistor R3. The inverting input of the OP AMP A1 is connected to the drain of the transistor M1 and one end of the resistor R1. The other end of the resistor R1 and that of the resistor R3 are connected to ground.

In the illustrative embodiment, the output current of the OP AMP A1 is provided with at high driving ability, so that a current great enough for operation is fed to the third serial circuit 3B. In the third serial circuit 3B, the reference voltage VREF appears on the anode of the diode D3.

In the embodiments preceding the illustrative embodiment, the transistor M3 sets up a phase difference of 180 degrees between the voltage signal output from the OP AMP A1 and the current signal of the current I2. By contrast, the illustrative embodiment replaces the connection of the differential input pair of the OP AMP A1 and omits the transistor M3. As a result, when the entire circuit is regarded as a negative feedback circuit, the number of components for inverting amplification is reduced by one. As for the frequency characteristic of the negative feedback circuit, the gain is reduced by −20 dB/Dec. This, coupled with the fact that the number of poles that delay the phase by 90 degrees is reduced by one, promotes easy design of stable feedback operation. Moreover, the absence of the transistor M3, which would deteriorate the frequency characteristic of the negative feedback circuit, contributes to stable feedback operation.

In summary, a BGR circuit of the present invention includes an OP AMP and a first, a second and a third serial circuit constituting a feedback control circuit in combination. The feedback control circuit reduces the influence of an offset voltage and therefore an error with respect to a designed value. Further, the BGR circuit reduces a temperature drift because temperature coefficients cancel each other. It follows that the BGR achieves high accuracy and frees IC samples from irregularity.

Various modifications will become possible for those skilled in the art after receiving the teachings of the present disclosure without departing from the scope thereof.

What is claimed is:

1. A bandgap reference circuit comprising:

a first serial circuit comprising a first diode, a first transistor and a first resistor serially connected together;

a second serial circuit comprising a second diode having a greater current feed area than said first diode, a second transistor and a second resistor serially connected together;

an amplifier for amplifying a difference between a voltage drop of said first resistor and a voltage drop of second resistor; and a third serial circuit comprising a third transistor control led by an output of said amplifier, a third resistor, a fourth resistor and a third diode serially connected together;

wherein opposite ends of said fourth resistor are respectively connected to a gate of said first transistor and a gate of said second transistor, and a reference voltage appears on opposite ends of a portion of said third serial circuit including said third resistor, said fourth resistor and said third diode.

2. The bandgap reference circuit as claimed in claim 1, wherein said first serial circuit and said second serial circuit are connected in parallel with each other and in series to a current source.

3. The bandgap reference circuit as claimed in claim 1, wherein said third transistor, said third resistor, said fourth resistor and said third diode are sequentially connected between a high-tens ion power source line and a low-tension power source line in this order.

4. The bandgap reference circuit as claimed in claim 3, wherein said first serial circuit and said second serial circuit are connected in parallel with each other and in series to a current source.

5. The bandgap reference circuit as claimed in claim 1, wherein said third transistor, said third diode, said third resistor and said fourth resistor are sequentially connected between a high-tension power source line and a low-tension power source line in this order.

6. The bandgap reference circuit as claimed in claim 5, wherein said first serial circuit and said second serial circuit are connected in parallel with each other and in series to a current source.

7. A bandgap reference circuit comprising:

a first serial circuit comprising a first diode, a first transistor and a first resistor serially connected together;

a second serial circuit comprising a second diode having a greater current feed area than said first diode, a second transistor and a second resistor serially connected together;

an amplifier for amplifying a difference between a voltage drop of said first resistor and a voltage drop of second resistor; and a third serial circuit comprising a third resistor, a fourth resistor and a third diode serially connected together between an output line of said amplifier and a low-tension power source;

wherein opposite ends of said fourth resistor are respectively connected to a gate of said first transistor and a gate of said second transistor, and a reference voltage appears on said output line of said amplifier.

8. The bandgap reference circuit as claimed in claim 7, wherein said first serial circuit and said second serial circuit are connected in parallel with each other and in series to a current source.

9. The bandgap reference circuit as claimed in claim 7, wherein said third diode, said third resistor and said fourth resistor are sequentially connected between the output line of said amplifier and a low-tension power source line in this order.

10. The bandgap reference circuit as claimed in claim 9, wherein said first serial circuit and said second serial circuit are connected in parallel with each other and in series to a current source.

* * * * *